US010132336B1

(12) United States Patent
Theobald

(10) Patent No.: US 10,132,336 B1
(45) **Date of Patent: *Nov. 20, 2018**

(54) ACTUATOR FOR ROTATING MEMBERS

(71) Applicant: Daniel Theobald, Somerville, MA (US)

(72) Inventor: Daniel Theobald, Somerville, MA (US)

(73) Assignee: VECNA TECHNOLOGIES, INC., Cambridge, MA (US)

( * ) Notice: Subject to any disclaimer, the term of this patent is extended or adjusted under 35 U.S.C. 154(b) by 441 days.

This patent is subject to a terminal disclaimer.

(21) Appl. No.: 13/867,329

(22) Filed: Apr. 22, 2013

(51) Int. Cl.
*F15B 15/20* (2006.01)

(52) U.S. Cl.
CPC ..... *F15B 15/20* (2013.01)

(58) Field of Classification Search
CPC ..... F01B 19/04; F15B 15/103
USPC ..... 92/89, 90, 91, 92
See application file for complete search history.

(56) References Cited

U.S. PATENT DOCUMENTS 2,642,091 A 6/1953 Henri
3,645,173 A 2/1972 Yarlott
3,830,519 A 8/1974 Lewis
3,892,079 A 7/1975 Hirano et al.
4,615,260 A 10/1986 Takagi et al.
4,671,258 A 6/1987 Barthlome
4,733,603 A 3/1988 Kukolj
4,739,692 A 4/1988 Wassam et al.
4,811,561 A 3/1989 Edwards et al.
4,819,547 A 4/1989 Kukolj
4,841,845 A 6/1989 Beullens
5,040,626 A * 8/1991 Paynter ..... B23Q 1/34 180/8.1
5,046,375 A 9/1991 Salisbury
5,080,000 A * 1/1992 Bubic ..... B25J 18/06 294/119.3
5,156,081 A * 10/1992 Suzumori ..... B25J 15/12 92/92
5,218,280 A 6/1993 Edwards
5,351,602 A * 10/1994 Monroe ..... F15B 15/103 60/413
5,529,293 A * 6/1996 Haugs ..... B63B 21/20 254/93 HP
6,168,634 B1 1/2001 Schmitz
6,223,648 B1 5/2001 Erickson
6,532,400 B1 3/2003 Jacobs
6,666,127 B2 12/2003 Peles
6,868,773 B2 3/2005 Davis et al.
6,896,704 B1 5/2005 Higuchi
7,104,182 B2 * 9/2006 Reininger ..... F15B 15/2869 92/5 R
7,331,273 B2 * 2/2008 Kerekes ..... B60N 2/4415 92/90
7,348,747 B1 3/2008 Theobald et al.
7,607,380 B2 10/2009 Hiramatsu et al.
7,719,222 B2 5/2010 Theobald
7,837,144 B2 * 11/2010 Kothera ..... B63B 1/248 244/99.2
8,185,243 B2 5/2012 Okazaki
9,506,481 B1 * 11/2016 Theobald ..... F15B 15/103
2002/0026792 A1 3/2002 Porter et al.
2002/0026794 A1 3/2002 Shahinpoor et al.
2002/0083828 A1 7/2002 Bemier (Continued)

*Primary Examiner* — Michael Leslie
*Assistant Examiner* — Matthew Wiblin

(57) ABSTRACT

A method and apparatus for controlling torsional rotation and/or stiffness of a member by the use of artificial style activation elements.

4 Claims, 6 Drawing Sheets

(56) References Cited

U.S. PATENT DOCUMENTS

| | | | | |
|---|---|---|---|---|
| 2002/0157322 | A1* | 10/2002 | Pedretti | E04H 15/20 52/2.13 |
| 2002/0157388 | A1* | 10/2002 | Seto | B25J 9/142 60/325 |
| 2003/0223844 | A1 | 12/2003 | Schiele et al. | |
| 2005/0028237 | A1 | 2/2005 | Greenhill et al. | |
| 2005/0126578 | A1 | 6/2005 | Garrison | |
| 2007/0084202 | A1 | 4/2007 | Hiramatsu et al. | |
| 2007/0129653 | A1 | 6/2007 | Sugar | |
| 2007/0140821 | A1 | 6/2007 | Garon et al. | |
| 2007/0233318 | A1 | 10/2007 | Lei | |
| 2009/0173223 | A1* | 7/2009 | Kudawara | F15B 15/103 92/92 |
| 2009/0276058 | A1 | 11/2009 | Ueda | |
| 2010/0001718 | A1 | 1/2010 | Howard et al. | |
| 2010/0089589 | A1 | 4/2010 | Crawford et al. | |
| 2010/0249675 | A1 | 9/2010 | Fujimoto | |
| 2010/0256540 | A1 | 10/2010 | Yamashiro | |
| 2010/0269689 | A1 | 10/2010 | Nakamura et al. | |
| 2011/0023474 | A1* | 2/2011 | Kudawara | B25J 9/1075 60/325 |
| 2011/0313331 | A1 | 12/2011 | Dehez | |
| 2012/0184881 | A1 | 7/2012 | Kobayashi | |
| 2014/0208937 | A1 | 7/2014 | Henry | |

* cited by examiner

| Property | Human Muscle | Hydraulics |
|---|---|---|
| Max. Strain ($L/L_0$) | 30-70% | 10-100% |
| Max. Stress (MPa) | .1-.4 | 20-70 |
| Power Density ($W/m^3$) | $5x10^5$ | $5x10^8$ |
| Density ($kg/m^3$) | 1000-1100 | 1600-2000 |
| Efficiency | 20-25% | 90-98% |
| Activation Frequency ($s^{-1}$) | 5 - 500 | 5 - 300 |
| Control Resolution | $10^{-4}$-$10^{-2}$ | $10^{-5}$-$10^{-4}$ |

ACTUATOR FOR ROTATING MEMBERS

This patent application claims is a continuation-in-part of U.S. patent application Ser. No. 13/625,200, filed Sep. 24, 2012, entitled, "Hydraulic Actuator," the disclosure of which is incorporated herein, in its entirety, by reference.

FIELD OF THE INVENTION

The present invention relates generally to actuators and, in at least one embodiment, to such actuators that are hydraulic or fluid powered and/or used as an artificial or "mechanical" muscle.

BACKGROUND OF THE INVENTION

Actuators typically are mechanical devices that are used for moving or controlling a mechanism, system or the like and typically convert energy into some type of motion. Examples of actuators can be found in any number of applications encountered in everyday life including automotive, aviation, construction, farming, factories, robots, health care and prosthetics, among other areas.

Mobile robotics and advanced prosthetics will likely play important roles in the future of the human race. Actuators frequently are used in these applications that enable movement of a robot or user arm or other appendage or item as desired.

Most existing mobile robots and advanced prosthetics, however, lack the strength and speed necessary to be effective. This is because they suffer from poor specific power (strength×speed/weight) which determines how quickly work can be done compared to another actuator of the same weight.

For example, if such devices are capable of lifting significant weight, they must do so slowly, which inhibits their adoption for most applications. On the other hand, devices that can move more quickly are just not capable of handling significant weight.

SUMMARY OF THE INVENTION

In accordance with one embodiment of the invention, a method and apparatus for is provided for controlling torsional rotation and/or stiffness of a member by the use of artificial style activation elements.

BRIEF DESCRIPTION OF THE DRAWINGS

The following detailed description will be better understood when read in conjunction with the appended drawings in which there is shown one or more of the multiple embodiments of the present disclosure. It should be understood, however, that the various embodiments of the present disclosure are not limited to the precise arrangements and instrumentalities shown in the drawings.

FIG. 4 is a partial cross-sectional view of one embodiment of the present invention illustrating a plurality of activation elements enclosed in an outer sheath member or the like;

DETAILED DESCRIPTION OF THE INVENTION

Figure 1:
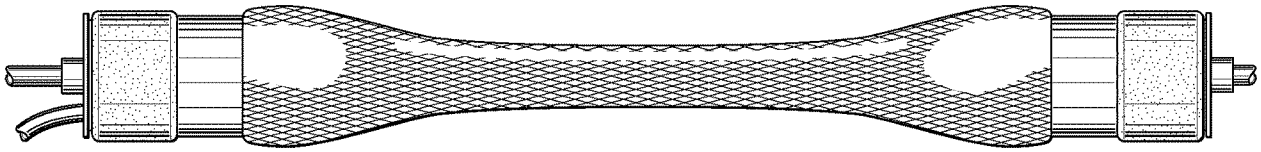
FIG. 1 is a plan view of one embodiment of an activation element of the present invention that may be utilized with the actuator of the present invention illustrated in a first "at rest" position.

Various embodiments of the present invention are described below with reference to the accompanying drawings. It should be understood that the following description is intended to describe exemplary embodiments of the invention, and not to limit the invention.

It is understood that the present invention is not limited to the particular components, analysis techniques, etc. described herein, as these may vary. It is also to be understood that the terminology used herein is used for the purpose of describing particular embodiments only, and is not intended to limit the scope of the present invention. It must be noted that as used herein, the singular forms "a," "an," and "the" include plural reference unless the context clearly dictates otherwise. The invention described herein is intended to describe one or more preferred embodiments for implementing the invention shown and described in the accompanying figures.

Unless defined otherwise, all technical and scientific terms used herein have the same meanings as commonly understood by one of ordinary skill in the art to which this invention belongs. Preferred methods, system components, and materials are described, although any methods and materials similar or equivalent to those described herein can be used in the practice or testing of the present invention.

Many modifications and variations may be made in the techniques and structures described and illustrated herein without departing from the spirit and scope of the present invention. Accordingly, the techniques and structures described and illustrated herein should be understood to be illustrative only and not limiting upon the scope of the present invention. The scope of the present invention is defined by the claims, which includes known equivalents and unforeseeable equivalents at the time of filing of this application Various embodiments of the present invention are directed to various devices that are fluid powered, such as by hydraulics or pneumatics, for example. It is to be understood, however, that some embodiments of the present invention are not limited to these two specific technologies.

In operating a robot, advanced prosthetic, or some other item or mechanism, some type of power system typically is provided to enable particular movement, such as moving an arm or other appendage, for example. As readily can be discerned, in order to provide at least up and down movement to an arm member or the like some type of mechanical or other actuator typically is employed.

In a simple example, a piston driven actuator may be implemented to accomplish this movement. By moving the piston back and forth within a cylinder, the piston rod provides the basic movement to the arm member connected at is distal end.

Another type of actuator can be one that mimics the motion of a real biological muscle in the body of a human or other animal. These artificial or mechanical muscles typically provide some type of expandable member or tube connected at one end to an arm member, such as a forearm of a robot, for example, and at the other end to another member such as the upper arm or shoulder of a robot, for example.

Briefly, in operation, when such a member is expanded in a direction substantially perpendicular to its longitudinal centerline, it essentially contracts the member thereby drawing the arm closer to the shoulder. When the member is thereafter allowed to expand in a direction substantially parallel to its longitudinal centerline, it essentially extends the member and the arm moves away from the shoulder.

One example of such a mechanical muscle is known as a McKibbons style actuator, which is hereby incorporated by reference. It is to be understood, however, that the particular type of mechanical muscle and corresponding expanding member can vary without departing from the teachings of various embodiments of the present invention.

These types of actuators or mechanical muscles exhibit a specific power (strength×speed/weight) that far exceeds that of existing actuators typically used in robots that suffer from poor efficiency, noisy operation, high cost and maintenance challenges, among other drawbacks. These drawbacks and more are readily solved by the design of illustrative embodiments of the present invention that readily exceed the performance of real biological muscles.

Additionally, as the human race begins to work in close collaboration with robots, advanced prosthetics, and similar machines and mechanisms, they are anticipated to expect the robots to be stronger, faster, have better endurance, be more precise, and cost less than other options. They also may expect robots to quickly and efficiently carry out their assigned physical tasks with little or no down time for maintenance or fatigue, for example.

Biological muscles consist of many smaller "actuator" fibers called sarcomeres, bundled in parallel. During movement of a body limb, for example, all or just a partial subset of available fibers may be activated depending on the task involved.

By scaling down the size of mechanical muscles, arranging them in bundles and designing them to handle much higher hydraulic pressures, a large increase in specific power is achieved. Significant reduction in the overall weight of this design, among other factors, leads to this increase in specific power. At the same time, by activating any number of the actuators arranged in such a bundle to vary the power output for the task at hand, significant power savings is achieved.

When employing these types of mechanical or artificial muscles, the trend is to provide a single actuator for each direction of desired motion. With this design, variations in movement and control are limited.

One key feature among many of illustrative embodiments is to provide a plurality of discrete, readily interchangeable mechanical muscles for each direction of desired motion, where each muscle has a predetermine power capability. Additionally, if more power is needed more muscles can be added. This concept dramatically teaches away from conventional thinking, provides a number of distinct and unexpected results and advantages in the art, and essentially revolutionizes the potential applications possible.

As one example, by using a plurality or bundle of muscles, the number of muscles activated can vary depending on the power requirements of the task at hand. One advantage of this novel design concept is power conservation, which is particularly important with mobile robots as well with overall environmental concerns.

Another advantage is in the type and number of potential applications that become available by using a bundle of muscles. With conventional thinking being to merely increase the size of the actuator or muscle to increase the power capability of the device, applications are limited to larger and larger devices. In the design discussed herein, smaller and smaller applications are possible since the actuators can be smaller and lighter, among other attributes.

Examples of various hydraulic systems and robotic applications where a mechanical muscle may be employed can be found, for example, in applicant's issued U.S. Pat. No. 7,348,747 filed Mar. 30, 2006, issued U.S. Pat. No. 7,719,222 filed Mar. 24, 2008 and pending U.S. patent application Ser. No. 12/731,270 entitled "Task Flexibility for Actuators" filed Mar. 25, 2010 and related co-pending applications, all of the disclosures of which are hereby incorporated by reference. It is to be understood, however, that the particular details of the hydraulic system itself, as well as the robot, vehicle, tool, heavy equipment, actuator, or other apparatus, can vary without departing from the teachings of various embodiments of the invention.

Figure 2:
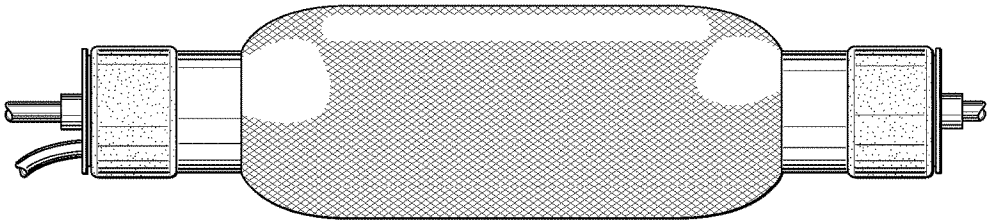
FIG. 2 is a plan view of the element of FIG. 1 illustrated in a second activated position.

FIGS. 1 and 2 generally illustrate one embodiment of a mechanical muscle 10 that may be employed in various embodiments of the present invention. The muscle 10 also is referred to as an "activation element 10, "artificial muscle style activation element," or as an "actuator 10." The particular size, shape, material and design of the muscle 10 can vary so long as it falls within the scope of the appended claims.

Briefly, in operation, FIG. 1 generally illustrates the muscle 10 in an extended or at-rest position where no fluid is provided to the interior of the muscle 10. As FIG. 2 generally illustrates, when fluid is provided to the interior of the muscle 10, the muscle 10 expands in a direction substantially perpendicular to its longitudinal centerline, essentially contracting the muscle 10, thereby shortening it length. Conversely, when fluid is essentially released from the interior of the muscle 10, the muscle 10 expands in a direction substantially parallel to its longitudinal centerline, thereby increasing its length.

As readily can be discerned and described in more detail below, if the muscle 10 is attached on opposite ends to other members, desired movement between the members can be achieved. Additionally, the particular type, shape, material and design of the muscle 10 can be varied to in turn vary the movement between the two members to which it is attached.

Figure 3:
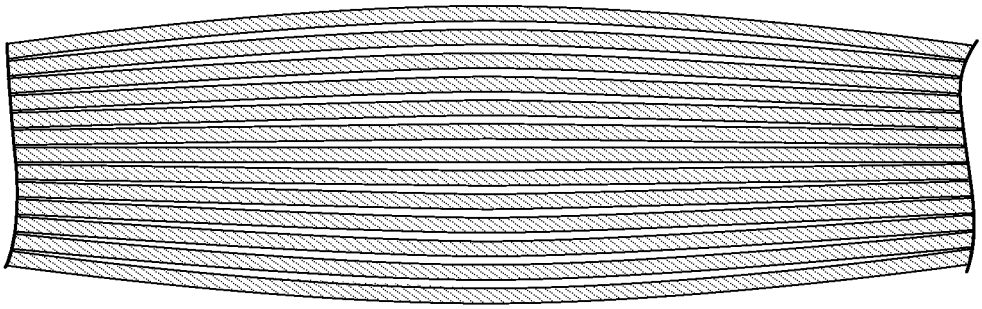
FIG. 3 is a partial plan view of one embodiment of the present invention illustrating a plurality of activation elements arranged in a bundle.
Figure 4:
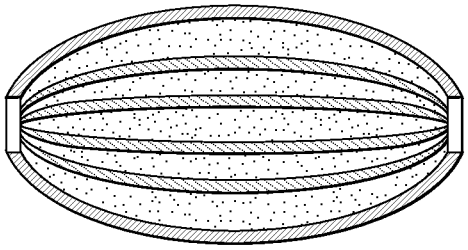
Figure 5:
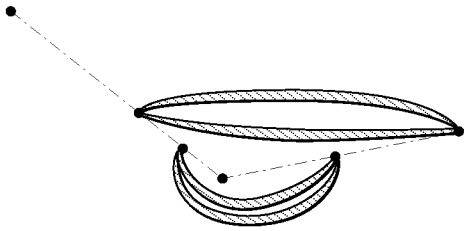
FIG. 5 is a semi-schematic view of one embodiment of the present invention illustrating one potential use of the activation elements.

As FIG. 3 generally illustrates, the number of muscles 10 utilized can be expanded to vary the performance of the muscle 10 as needed. In particular, by providing a number of muscles 10 in one or more bundles 12 a corresponding increase in the lifting or movement capacity of the muscle 10 or bundle 12 can be accomplished.

Existing actuators for robot, prosthetics, and the like are heavy and lack the specific power and energy efficiency necessary for effective designs. This limits the number, strength, and speed of each degree of freedom in a robot or the like.

While the human body has over 600 individual skeletal muscles, the most advanced humanoid robots in existence today can afford only 50 or so conventional actuators and still end up weighing twice as much as a human, which can present a safety issue when working closely with humans. To be truly capable and safe, robots and prosthetics need to be stronger, weigh less, and have many more degrees of freedom than current systems.

Pneumatic actuators or mechanical muscles are limited by their relatively low operating pressure of about 100 PSI and poor controllability due to the compressible nature of air, which is generally the working fluid in such pneumatic systems. By utilizing a design incorporating hydraulically actuated actuators or mechanical muscles as described herein that are capable of operating at much higher pressures of about 3000 PSI, incredible increases in power are provided while increasing controllability.

As the goal of robotics aims to supplant human labor, human skeletal muscle is an appropriate standard to beat. Muscles provide adaptive, integrated closed-loop positional control; energy absorption and storage; and elastic strain to allow for deformation of tissue under loads. They are rapidly responsive and able to adjust spring and damping functions for stiffness and compliance in stability, braking, and more. A viable artificial actuation approach should at least provide such comprehensive functionality; additionally such an approach should meet or exceed the set of performance metrics of human muscles and improve upon muscles' limited peak performance envelope.

Figures 6, 7:
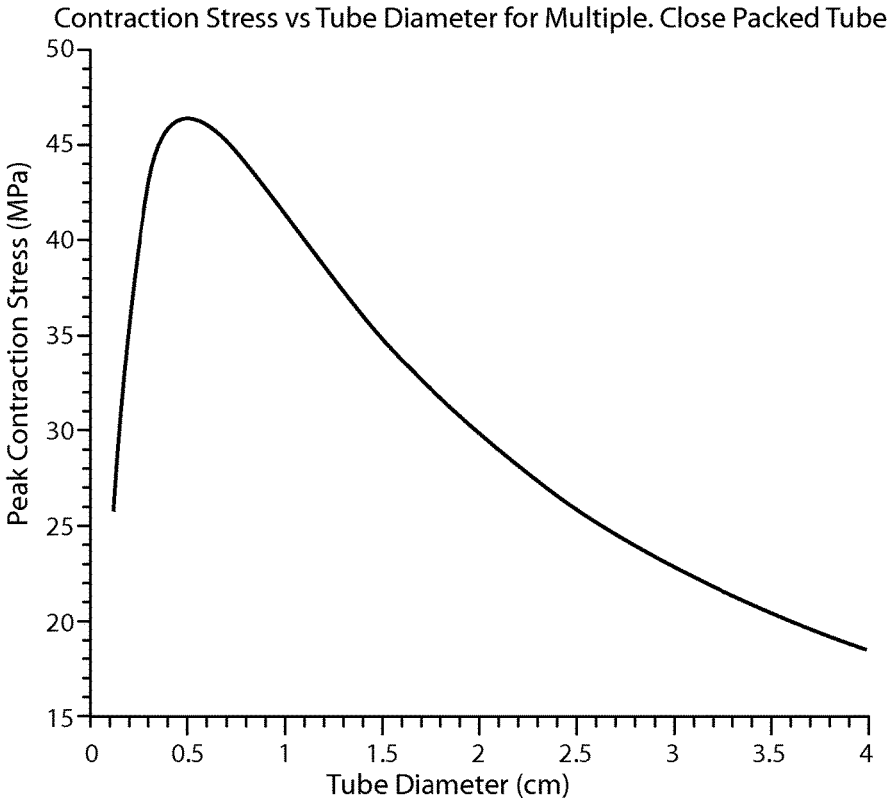
FIG. 6 is a table illustrating performance characteristics of human muscles and hydraulic systems.
FIG. 7 is a graph illustrating contraction stress vs. tube diameter.

As FIG. 6 illustrates, hydraulic mechanical muscles 10 outperform human muscle in power density, efficiency, stress vs. strain, frequency, control resolution, and will closely match human muscle in density, and variable compliance ability. In addition, hydraulic mechanical muscles will also achieve significant improvements in the state of the art in terms of cost, manufacturability, flexibility in application, and scalability. As described earlier, the specific power factor is an important criterion that implies the simultaneous speed and strength needed for things like running and throwing.

While existing somewhat exotic actuator technologies may exceed any single actuator performance metric, they are unable to provide comparable overall performance. For example, piezoelectrics are unacceptably brittle; shape memory alloys (SMAs) have prohibitively slow response cycles due to a temperature-dependent actuation; magnetostrictors require constant, fragile magnetic fields at large scales.

Additionally, electroactive polymers (EAPs), require large and potentially unsafe actuation voltages (>1 kV, typical) and consistent current to maintain displacement, possibly making them unacceptably inefficient while chemically-activated ionic versions do not consistently sustain DC-induced displacement and have slow response times. Additionally, EAPs have difficulty damping for low frequency vibration and inaccurate position sensing capabilities due to inherent actuator flexibility. Since biological joints are analogous to direct-drive actuation and therefore largely backdrivable (i.e. resilient), the same forces acting upon an EAP actuator in a leg for example will cause it to deform and perform unexpectedly. Most of all, these materials are prohibitively expensive and complicated to manufacture.

More conventional existing actuators fail to replicate muscle-like performance for a number of reasons. Electromagnetic approaches lack any real scalability because of their need for expensive, high power, rare-earth magnets. Their highly specialized motor design precludes the force output properties of muscle tissue.

Out of all available actuation techniques, pneumatic actuators, particularly of the "mechanical muscle" or McKibbens type described above appear to most closely match the force-velocity and force-length characteristics of human muscle. These pneumatic actuators exploit the high power density, light weight, and simplicity of fluid power, but precise control of these systems is difficult because of the compressibility of air and the inherent excessive compliance, hysteresis, nonlinearity, and insufficient contraction rates of rubber actuators.

In contrast, a hydraulic approach to mechanical muscle fluid power avoids these limitations while at the same time offering inherent advantages for adjustable compliance, proportional force output, energy recovery and efficiency, precise control, and scalability. This broad complement of properties makes hydraulics an excellent candidate for biometric actuation.

In fact, the overall superior performance of hydraulics for vibration damping, actuation frequency, and volumetric power for compact designs in general applications are well known. Furthermore, since hydraulics operate on virtually the same principles as pneumatics, which perform comparably to natural muscle, they are similarly suitable for artificial muscles if used in the right actuator design. As such, a new paradigm in actuator approach is provided in at least one embodiment of the present invention that leverages the superior power and controllability of hydraulics with biophysical principles of movement. This can enable providing more lifelike actions such as throwing an object, for example, where the flexibility enables floppy joints and power to flow through an article such as a mechanical arm as described elsewhere in this specification.

One of the many significant benefits of a bundle of mechanical muscles approach is that simultaneous activation of all of the bundled actuators becomes unnecessary; rather, there is the potential to activate only the minimum of muscle fibers or actuators that are needed for the task. Benchtop tests demonstrated a 3 inch displacement for a strain of 70%. Maximum pulling force (before material failure) was approximately 95 pounds at a pressure of nearly 1800 PSI. This bundle approach to mechanical muscles will achieve at least 10 times the specific power of human muscle while achieving similar impedance control, and will be practical for use in robotic systems. As this type of system is perfected, additional increases in specific power are anticipated.

Human muscle is comprised of both pennate (fibers aligned at an angle to the muscle's long axis) and parallel-fibred muscles, each with functionally-specific mechanical features: pennate muscles act around joints, rotating their angle to act as variable gears, while parallel-fibered muscles are the workhorses (cf. biceps brachii or soleus) of load-bearing movement. The mechanical advantage of a bundle of small or miniature McKibbons type actuators is similar: since Pascal's Law holds that increases in fluid pressure are distributed equally to all parts of a system, force increases proportionally with the cross-sectional area of the actuator. Since it has been identified that adjustable force output can be a function of increased actuator diameter, using bundles or clusters of miniature McKibbons type actuators can scale upward in cross-sectional area through the addition of more actuators; since the individual actuator size does not increase, tolerances for pressure and stress remain the same while force output increases.

In a cylindrical pressure vessel, like a McKibbons Actuator, the effect of hoop stress from fluid pressure dominates the tensile stress in the individual fibers. It is established that $$T = \frac{PDd}{2\sin(\theta)} \tag{1}$$

where P, D, d, and θ are the fluid pressure, actuator tube inner diameter, fiber diameter, and weave angle respectively. As expected, the hoop stress, and therefore the tension, increase as a function of actuator diameter. The relationship for the peak contractile force (F) of a McKibbons style actuator can be expressed as:

$$F = \frac{\pi}{4} D_o^2 P \frac{1}{\sin^2(\theta)} (3\cos^2(\theta_0) - 1) \tag{2}$$

where θo and Do represent the weave angle and diameter of the actuator while at rest. For a given fiber, with diameter d and max tensile stress $\sigma_t$, and initial weave angle θo we can use Eqns. (1) and (2) to determine the maximum allowable fluid pressure as a function of diameter Do.

$$T_{max} = \frac{\pi}{4} \sigma_t d^2 \tag{3}$$

$$P_{max} = T_{max} \frac{\sin(\theta_o)}{2Dd} \tag{4}$$

Substituting $P_m$ax into (2) allows for calculation of the peak contractile force $F_{max}$ as a function of diameter. Here, we consider the bundle of McKibbons actuator or BoMA approach where a single, large actuator can be replaced with multiple smaller actuators. By using smaller cylinders, a significantly higher fluid pressure can be used. Let t be the thickness of the actuator tube and fibers, so that the outer diameter of the actuator is D+t. Then, we can calculate the peak contractile stress as, $$\sigma_{max} = \frac{4F_{max}}{\pi(D+t)^2} \tag{5}$$

Using sample system parameters for θ, d, and t, and the tensile strength for high strength polyethylene, FIG. 7 shows the peak contraction stress over a range of possible tube diameters. Note the peak near D=0.6 cm, which illustrates that the tube diameter at which the greatest force density can be achieved. In a real system, cylinders can only be close packed to overall density of 78%, so there is a slight advantage to using a single McKibbons actuator. However, as seen in the figure, this 22% difference is small when compared with the improvement in force density from using multiple cylinders. When compared with a single actuator with a 4 cm diameter, the BoMA approach with multiple 0.6 cm diameter actuators more than doubles the potential force density.

Hydraulics also enables important advantages for replicating the principle of co-contraction in biarticulate, flexor/extensor muscle groups. Co-contraction has been shown to perform multiple functions in humans and animals, including a reduction of variability in reaching movements through increased stiffness produced by muscle activation and robustness to perturbations and an increase in joint impedance for greater limb stability, the quick generation of torque, and compensation for torque components orthogonal to desired trajectories. This helps enable the lifelike performance of robotic elements that is one aspect of the present invention.

In the BoMA or perhaps more appropriately the BoHMA (Bundle of Hydraulic McKibbons Actuators) approach, the stiffness inherent to the incompressible hydraulic fluid allows for precise control of a manipulator or leg through co-activation; for example, differences in simultaneous agonist (biceps brachii) contraction and antagonist (triceps brachii) contraction determine the position of the forearm. Isometric force can be determined by summing antagonist muscle torques; stiffness and torque can thus be controlled independently. This stiffness can be dynamically increased or decreased according to task requirements; greater stiffness allows for more precise control, while decreased stiffness enables more compliance. Additionally, the parallel elastic element in musculature acts as a lightly damped, non-linear spring which is the primary source for the passive tension (i.e., compliance) under eccentric loads which facilitates the contractile element's return to resting length. The elastic sheath of the fibers will provide some of this passive tension.

Hydraulics will inherently provide the remainder of damping using valves with adjustable orifices to produce a damping force proportional to the speed of movement. Since the biological tendon may contribute a great portion of compliance and therefore affect stiffness during locomotion, elasticity should be adjustable. Such stiffness will need to be counterbalanced with sufficiently high-bandwidth active and passive compliance to provide robustness to collisions and to maximize safety around humans. Thus, a key design characteristic of the BoMA approach is a range of compliance in both spring and damping characteristics. Approaches to compliance can be divided into two categories: passive and active. Passive approaches use the natural characteristics of materials to achieve spring and damping effects. Active compliance, on the other hand, is achieved by moving the actuator in a way that mimics a desired compliance.

Previously developed active approaches, such as the Series-Elastic Actuator use an actuator and tight control loop to mimic compliance of passive materials. In this approach, basic compliance is achieved through placement of spring between actuator and load; a linear potentiometer used to measure the spring's length provides force sensing that is combined with position sensors to facilitate rapid adjustments for desired position, velocity, springiness and damping gains. The series-elastic principle can be implemented using a hydraulic actuator that features low impedance and backdriveability; accordingly, the BoMA approach will be backdriveable.

For the BoMA approach, passive compliance is achieved through a number of means, including: the natural elasticity of the contractile sheath of the BoMA fibers, which provides a small restoring force back to resting length; through the elastic "tendons" arranged in series with the BoMA clusters, connecting them, with connectors at various locations (e.g., at the ends of the clusters), to the robot skeleton; through co-contraction control policies using adjustable stiffness; and through scalable actuation of individual fibers within clusters, exploiting the compliance of the surrounding unpressurized actuator material.

Figure 8:
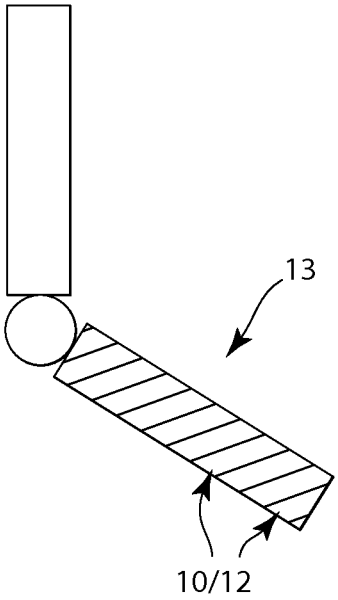
FIG. 8 is a schematic, side view of a movable member having a torsional stiffening apparatus.

In illustrative embodiments, the activation elements 10 have the capability of increasing the stiffness of a member. For example, FIG. 8 schematically shows a member 13 having a plurality of activation elements 10 wrapped around its outer periphery. In this example, the activation elements 10 are wrapped around the forearm portion of a robotic arm. More specifically, this example wraps the activation elements 10 around a tubular or cylindrically shaped member 13, from its distal end to its proximal end (near the elbow).

Torsional stresses can structurally damage the member 13. This may limit the force that the member 13 can apply to external objects, such as a stiff door knob. Accordingly, when actuated, the activation elements 10 apply a torsional stiffening force reinforces the torsional strength of the member. Accordingly, if the activation elements 10 were absent or not actuated, then application of an external torsional force to the member may damage the member 13. However, the activation elements 10 may activate in response to the external torsional force, at least partly counteracting the external torsional force, protecting the structural integrity of the member 13. This can be particularly useful when the torsional strength of the member is relatively low.

In addition to being formed from a rigid material (e.g., titanium), the member 13 may be formed from a semi-rigid, elastic, or flexible material, or even from a plurality of closely aligned members. Accordingly, the activation elements 10 may stiffen the member as needed. For example, if a semi-rigid or thin-walled robotic arm were turning a stuck door knob, then a controller may actuate the activation elements 10 to provide more support to the walls of the arm. This in turn should enable the robot to apply a higher torsional force to the door knob.

Figure 9:
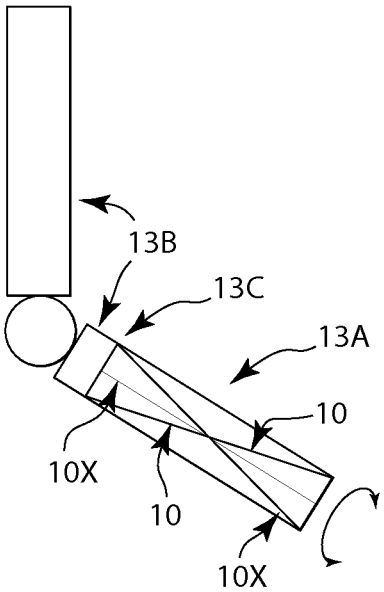
FIG. 9 is a schematic, side view of a movable member rotatably connected with a primary structure in accordance with one embodiment of the invention.
Figure 10:
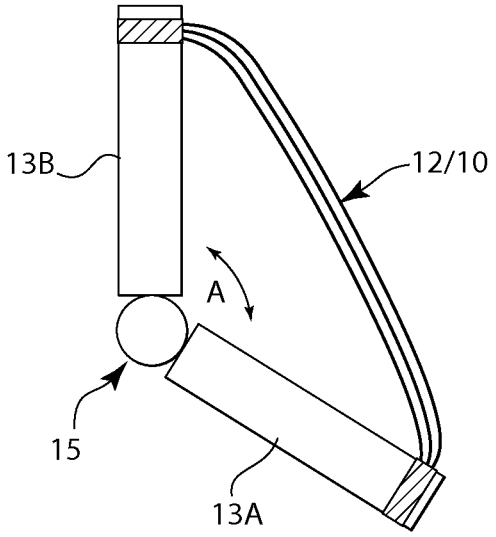
FIG. 10 is a schematic, side view of a movable member rotatably connected with a primary structure in accordance with another embodiment of the invention.
Figure 11:
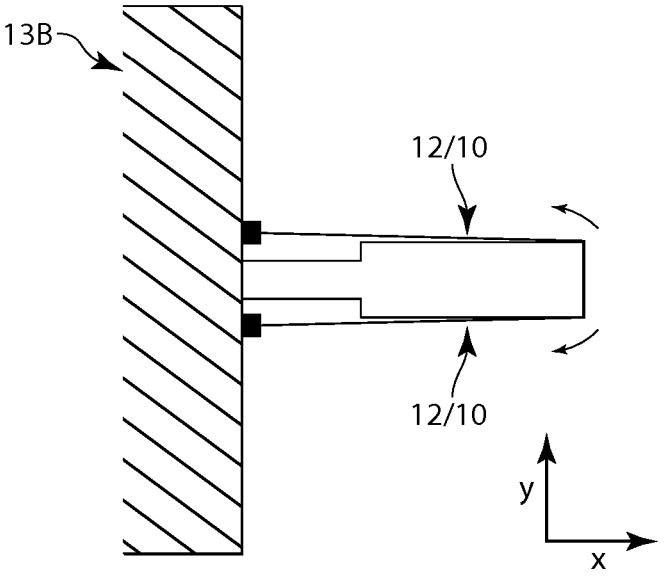
FIG. 11 is a schematic, side view of a movable member rotatably connected with a primary structure in accordance with yet other embodiments of the invention.

It should be noted that each activation element 10 discussed with regard to FIG. 8, as well as the below discussed FIGS. 9-11, can be in bundle form. Accordingly, discussion of activation elements 10 with regard to FIGS. 8-11 should be construed to apply equally to bundles 12. In other words, bundles 12 can be substituted for actuators 10 in this description of these figures.

Illustrative embodiments use bundles having activation elements 10 (e.g., McKibbons bundles) with small diameters. Accordingly, such embodiments may wrap two or more bundles 12 around the member 13 to provide the requisite stiffness/torsional strength. Those skilled in the art can arrange the multiple bundles 12 in any of a variety of different arrangements depending on the desired functionality.

The actuators/activation elements 10 also have the capability of rotating, torquing, or twisting two different members relative to one another. FIG. 9 schematically shows one such embodiment having a movable/rotatable member 13A connected with a stationary member 13B (also generally referred to as a "stationary structure 13B"). To facilitate rotation and/or apply a torsional force, this embodiment has a rotatable connection member 13C between the two members 13A and 13B. For example, an axle, driveshaft, or other rotatable member can movably connect between both members 13A and 13B. Alternatively, one of the two members 13A or 13B can have an extending portion that serves the function of the connection member 13C.

As shown, one or more activation elements 10 span the movable member 13A. For example, one end of each activation element 10 is secured to the stationary member 13B, while the other end is secured to the distal end of the movable member 13A. Each activation elements preferably is connected to different locations on the stationary member 13B and different locations at the distal end of the member. As an example, FIG. 9 shows three activation elements 10 connected about 120 degrees apart on the distal end of the movable member. That figure also shows both activation elements 10 connected about 120 degrees apart on the stationary member 13B.

Some embodiments may have two activation elements 10, e.g., one on each side of the movable member 10A, where each is connected 180 apart at their respective anchor/connection points. Another embodiment has only a single actuator 10 to produce rotation. Other embodiments may have four or more activation elements 10. For example, a cylindrical movable member 13A may have four activation elements 10, where each is connected about 90 degrees apart at its distal end. A controller or other logic may selectively actuate the different activation elements 10, depending upon the application. Any of the noted embodiments may also include biasing devices, such as springs, that normally apply a torsional force to the movable member 13A, which can be counteracted by the activation elements 10.

When used in a humanoid robotics context, for example, the movable member 13A, stationary member 13B and connection member 13C may be part of a robotic arm. For example, the robotic forearm may form the movable member 13A, while the upper arm and elbow portion of the arm may form the stationary member 13B. The connection member 13C may be considered to be part of either portion 13A or 13B, depending on the desired configuration.

The ends of each activation element 10 preferably are secured so that when in use, the movable member 13A rotates. To that end, when not actuated or not fully actuated (i.e., when longer), the activation element 10 is wrapped partially around the movable member 13A which cannot be done with larger diameter elements. FIG. 9 shows two activation elements 10 partly wrapped around the member 13A. Actuation of one of the activation elements 10 causes the actuation element 10 to reduce its length, which causes the member 13A to rotate. Specifically, the movable member 13A rotates in response to torsional forces of the shortening activation element aligning its entire length along substantially a straight line—toward a configuration where the activation element is not wrapped around the actuation element. FIG. 9 shows a third activation element 10*x* that is aligned in this manner, i.e., generally in a straight line. The other two activation elements 10 are at least partly wrapped around the member 13A. To rotate in the other direction, or to apply a torsional force in the other direction, one or more of the other activation elements 10 will actuate/shorten, while the actuated activation element relaxes, thus lengthening. Some of the activation elements 10 therefore may be considered to cooperate to actuate in an inverse manner.

Various embodiments may use single actuators 10 formed from material that is normally biased to increase in length. Accordingly, positive hydraulic or other pressure may be directed into the actuators 10 to shorten their length against the natural bias of the material. Release of this hydraulic or other pressure therefore causes the activation element 10 to increase in length, which, depending on the biasing force, can cause the member 13A to move in the opposite rotational direction.

Indeed, those skilled in the art can use actuators 10 to rotate/twist movable members 13A in other ways. FIGS. 10 and 11 show a few other examples, but are not intended to suggest that they are the only ways of doing so. For example, FIG. 10 shows one such example where a single actuator or bundle 10/12 connects between two members 13A and 13B that are pivotably/rotatably connected to one another; namely, a stationary member 13B connected to a movable member 13A via a hinge 15 or some other pivotable/rotatable component. It should be noted that the stationary member 13B in this and other embodiments may be movable about some third member or other member that is not shown. To simplify this discussion, however, it is discussed as being stationary and thus, should not be intended to limit various embodiments the invention. In other words, the stationary member 13B may move relative to other components within a larger system, such as a robotic system.

Accordingly, during operation, the activation element 10 reduces the angle (identified in FIG. 10 as "Angle A") between the two members 13A and 13B by shortening its length. In a corresponding manner, the activation element 10 increases Angle A between the two members 13A and 13B (connected by a joint) by increasing its length. The movable member 13A may be weighted so that it does not require a second activation element 10 or other mechanism to urge it away from the stationary member 13B when the activation element 10 increases its length. Alternatively or additionally, a spring or other mechanism in the pivot/joint region 15 may normally bias Angle A between the members 13A and 13B toward being larger, thus further eliminating the need for additional actuators 10.

Some embodiments may have no bearings, hinges, or other mechanisms to smoothly rotate the movable member 13A. FIG. 11 shows an example of one such embodiment, in which the movable member 13A has a thinner region connected to the stationary member 13B that readily bends, flexes, or moves in some expected manner in response to the movements of its two actuators 10. The thin region therefore acts as a spring and thus, should be formed from a material and structure that can withstand the torsional and rotational movement. Other embodiments do not have a thinner region but still function in the same or a similar manner. In some embodiments, rather than having just an operative connection or direct connection, the movable member 13A and stationary member 13B are an integral structure—i.e., they form a single member. Indeed, other embodiments may have similar integral relationships.

The position of the actuators 10 in the 360 degrees around the movable member 13A influences the actual motion of the movable member 13A. For example, the two actuators 10 shown in the figure may be on opposite sides of the movable member 13A. Accordingly, inverse actuation of the two activation elements 10 causes the movable member 13A to bend or twist in opposite directions. Alternatively, two or more actuators 10 may be positioned and activated to cause the movable member 13A to pivot/twist in asymmetrical directions. As another example, two or more actuators 10 may be positioned in a way that both rotates the movable member 13A generally about its longitudinal axis, while rotating it at an angle to the Y-axis (discussed below).

As noted above, the examples discussed above with regard to FIGS. 8-11 are not intended to limit various embodiments the invention. In fact, they may be combined as desired to produce specific results. For example, the embodiment of FIG. 10 may be added to the embodiment of FIG. 11 to selectively rotate the movable member 13A about its longitudinal axis and/or pivot the movable axis as noted above. Accordingly, discussion of any of the specific embodiments is merely exemplary of various implementations covered by the appended claims, and they may be combined in any functional manner as required by those skilled in the art.

Figure 12:
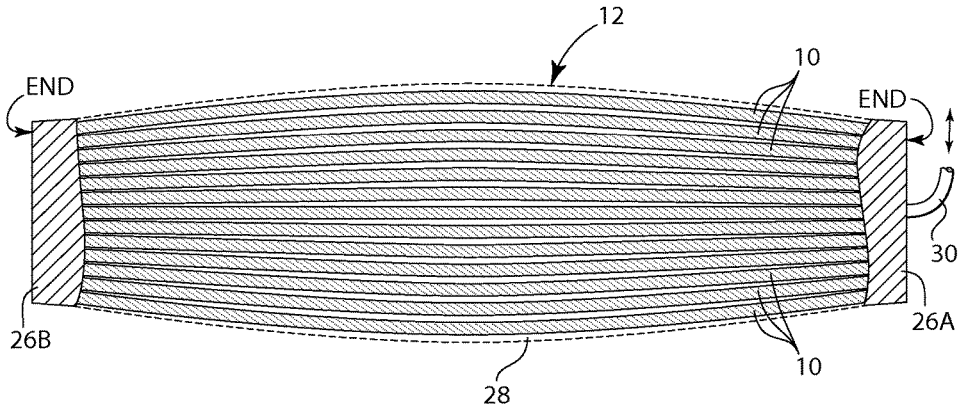
FIG. 12 schematically shows more details of a bundle of actuators in accordance with one embodiment of the invention.

FIG. 12 schematically shows more details of one embodiment of the actuators/bundles 10/12 shown in FIGS. 8-11. This figure shows the activation element 10/12, with its plurality of independent actuators 10 that each can be independently activated and controlled as needed to vary its output power. Accordingly, as discussed above, only selected numbers of actuators 10 may be actuated, depending upon the requirements of the application. For example, only one or two actuators 10 may be actuated, or all of the actuators 10 may be actuated. The ultimate use or function is expected to determine the number of actuators 10 that are actuated. Among other ways, the specific actuators 10 that are actuated can be selected automatically by some prescribed logic, on the fly by some prescribed logic, or in a manner selected by a user at the moment of use This figure also shows one embodiment of the first and second connectors 26A and 26B, one or both of which may both be movable. Those connectors 26A and 26B may be implemented from a wide variety of connection mechanisms that are adapted to be removably or permanently connectable with some underlying structure. For example, among other things, the connection mechanisms may include Velcro, snaps, buttons, or other securing mechanisms known in the art that provide a removable or non-removable connection.

Figure 13:
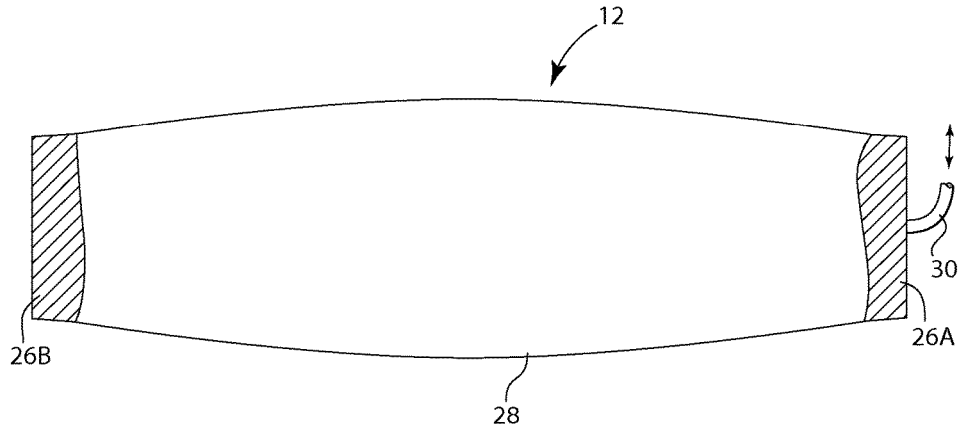
FIG. 13 schematically shows more details of a bundle of actuators in accordance with other embodiments of the invention.

Some embodiments of the invention also may have an optional substrate or base ("substrate 28") of some form supporting the bundle 12 of actuators 10. Dashed lines in FIG. 12 schematically show the substrate 28. Although extending slightly beyond the boundary of the activation element 10/12 in the figure, the substrate 28 may be thinner and thus, contact less than the entire surface area of the actuator 10/12. In a manner similar to the securing elements 26, the substrate 28 should be flexible and strong. FIG. 13 shows one embodiment in which the substrate 28 completely covers the activation element 10/12 of actuators 10.

The actuator 12 also includes some mechanism for actuating/activating the actuators 10. For example, FIGS. 12 and 13 schematically show a tube 30 for channeling fluid, such as a liquid, to and from the actuators 10 from a fluid driving and control source (not shown).

Those skilled in the art can vary the placement of the connectors 26A and/or 26B on its activation element 10/12. For example, some embodiments may position one or both of the connectors 26A and 26B at the ends of the activation element 10/12, as shown in FIGS. 8-13. Other embodiments, however, may position the connectors 26A and/or 26B somewhere between the ends of the activation element 10/12. In fact, some embodiments may have more than two connectors 26A and 26B.

Although the description above contains many specific examples, these should not be construed as limiting the scope of the embodiments of the present disclosure but as merely providing illustrations of some of the presently preferred embodiments of this disclosure. Thus, the scope of the embodiments of the disclosure should be determined by the appended claims and their legal equivalents, rather than by the examples given.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the embodiments of the present disclosure.

I claim:

1. A hydraulic system, comprising:

a first structure;

a rotatable member coupled to the first structure for rotational movement with respect to the first structure;

a plurality of elongate, artificial muscle style, incompressible hydraulic fluid activation elements arranged in at least one bundle of activation elements, the activation elements being arranged parallel and in side-by-side relationship with each other with respect to their lengths and substantially in contact with each other along their lengths, the plurality of activation elements combining when activated to provide a combined force substantially in a single direction, a first end of each activation element being attached to a portion of the first structure and a second opposite end of each activation element being attached to a portion of the rotatable member; wherein each activation element is wrapped about the periphery of the rotatable member less than 90 degrees and has a diameter less than one centimeter; and an incompressible hydraulic fluid pump system for variable, independent and selective activation and precise control of each activation element of the bundles to vary the amount of incompressible fluid pressure to each individual activation element so that when the pump system is activated the activation elements expand outwardly substantially perpendicular to their longitudinal axis to thereby decrease the length of each activation element and provide a desired amount of rotation of the rotatable member with respect to the first structure where the amount of rotation can be both controlled and varied as desired by at least increasing and decreasing the number of activation elements being activated.

2. The hydraulic system as defined in claim 1, wherein the diameter of the elongate activation elements is between 0.4-0.8 CM so that the bundle of activation elements has about twice the force density of a single activation element having a diameter at least five times greater than the activation elements in the bundle.

3. The hydraulic system as defined in claim 1, wherein the number of activation elements in the bundle is greater than 6.

4. The hydraulic system as defined in claim 1, wherein the number of activation elements in the bundle is greater than 12.

* * * * *